United States Patent [19]

Anzawa et al.

[11] Patent Number: 5,051,090

[45] Date of Patent: Sep. 24, 1991

[54] METHOD AND APPARATUS FOR BURNING LIQUID FUEL

[75] Inventors: Norio Anzawa; Koji Adachi; Tetsuo Futakawa; Koichi Honda; Shigekazu Fujii; Hironari Sato; Toshiyuki Irita, all of Muroran, Japan

[73] Assignee: Nippon Steel Corporation, Tokyo, Japan

[21] Appl. No.: 506,185

[22] Filed: Apr. 9, 1990

[51] Int. Cl.[5] ..... F23D 5/02

[52] U.S. Cl. ..... 431/331; 431/211; 431/335; 431/333

[58] Field of Search ..... 431/331, 335, 332, 333, 431/211

[56] References Cited

U.S. PATENT DOCUMENTS

| | | | |
|---|---|---|---|
| 2,710,652 | 6/1955 | Ambrose | 431/335 X |
| 4,443,180 | 4/1984 | LeFrois | 431/211 X |

FOREIGN PATENT DOCUMENTS

| | | | |
|---|---|---|---|
| 47-38368 | 12/1972 | Japan . | |
| 49-42018 | 11/1974 | Japan . | |
| 31256 | 3/1980 | Japan | 431/331 |
| 58-35713 | 3/1983 | Japan . | |
| 58-203307 | 11/1983 | Japan . | |
| 60-64134 | 4/1985 | Japan . | |

*Primary Examiner*—Larry Jones

*Attorney, Agent, or Firm*—Wenderoth, Lind & Ponack

[57] ABSTRACT

A method for burning foamed liquid fuel in a combustion chamber comprises the steps of foaming the liquid fuel and separately supplying air required for continuous stable combustion of the foamed fuel. An apparatus for carrying out the method is also disclosed.

17 Claims, 7 Drawing Sheets

METHOD AND APPARATUS FOR BURNING LIQUID FUEL

BACKGROUND OF THE INVENTION

1. Field of the invention

The present invention relates to a method and apparatus for burning liquid fuel in a wide range of applications from household oil stoves up to industrial furnaces.

2. Description of the prior art

Liquid fuel is burned for space heating (in stoves, for example), for heating materials, for powering prime movers such as internal combustion engines, and for other such purposes.

A heretofore known practice is to burn liquid fuel which is either directly gasified or which is finely vaporized by an atomizer.

The former method of burning the directly gasified fuel is widely used in general household oil stoves, typical of which are a pot type (JU-A-No. 35713/1983), a wick type (JP-A-No. 203307/1983 and No. 64134/1985) and a vaporization type (JIS 3030).

The pot type employs a burner bowl in which fuel is vaporized before being burned and is equipped with a combination of vaporization and combustion units. The wick type has a wick of asbestos or the like which is partially inserted into a fuel tank so as to absorb fuel from the tank. The wick is formed to have a large surface area so as to facilitate evaporation of the fuel. When the fuel absorbed by the wick is ignited, the flame spreads over the entire exposed area of the wick and continuous combustion ensues.

In the case of the vaporization type, fuel is vaporized in a vaporization chamber or pipe and then burned in a combustion unit, the vaporization unit being separated from the combustion unit.

Although the method of burning gasified fuel is used in some household oil stoves, it is more widely used in industrial furnaces, boilers and the like. This burning method is designed to promote vaporization and combustion reaction by gasifying liquid fuel into fine oil drops to increase the contact area of each drop with air.

Oil burners generally in use are adapted to burn fuel by means of a rotary burner, jet burner (vaporization spray, air spray and mechanical spray), special burner (gun-type high-pressure spray and low pressure spray) or the like. There are also examples having a kind of ignition device for igniting liquid fuel in the form of foam (JP-B-No. 42018/1974, JP-A-No. 38368/1972).

In the method of burning liquid fuel which is directly gasified using a pot, it is difficult to quickly increase combustion until the combustion chamber is sufficiently warmed after the fuel is ignited. Consequently, it takes a fairly long time before such oil stoves radiate heat satisfactorily after the fuel is ignited. In the case of the wick-type burning method, the range over which combustion can be adjusted is small and, depending on atmospheric conditions and the room size, it may be impossible to obtain ideal heating.

Moreover, there is generated an offensive smell from oil stoves when fuel is ignited or the flame is extinguished and this has caused oil stoves to be known for their bad odor.

From the point of safety, the flame in an oil stove has to be extinguishable as quickly as possible (e.g., according to JIS, the flame in the oil stove has to be extinguished within 10 seconds after an earthquake occurs or when it is tipped over by accident). The offensive smell generated when it is turned off therefore tends to become stronger.

This means the flame of an oil stove is required to be extinguished as quickly as possible after flame extinguishment is initiated. In the case of an oil stove, for instance, fuel is prevented from being vaporized from the wick or pot after the flame is extinguished and it is oxidized into aldehydes producing an irritant smell while passing through the hot combustion chamber. The problem is that the resulting strong offensive smell gives users an uncomfortable feeling.

Although there are many kinds of combustion equipment using the spray combustion method, they all allow groups of oil drops to have a wide distribution of particle sizes when they are dispersed by air; and these drops act on one another and move in different directions at different speeds.

As a result, spray combustion lacks uniformity, because oil drops insufficiently vaporized and mixed reach the front face of the flame before being enclosed in diffusion flame. The flame tends to become nonuniform, causing partial overheating of parts being heated.

Moreover, a device for spraying the oil is required and this results in high running costs such as high power cost.

In addition to the aforementioned disadvantages, the devices proposed in JP-B-No. 42018/1974 and JP-A-No. 38368/1972 function as ignition devices and are incapable of promoting continuous stable combustion.

SUMMARY OF THE INVENTION

One object of this invention is to provide a method for burning liquid fuel wherein the liquid fuel is foamed so as to obtain excellent controllability of the amount of combustion from a time immediately after ignition.

Another object of the invention is to provide a an apparatus for burning liquid fuel wherein the contact area between liquid fuel and air is increased so as to promote the vaporization and combustion of the liquid fuel.

Another object of the invention is to provide a method for odor-free extinguishment when the flame of burning foamed fuel is to be put out.

BRIEF DESCRIPTION OF THE DRAWINGS

Other and further objects of the invention will become apparent from the following specification, taken together with the attached drawings, in which.

DETAILED DESCRIPTION OF THE INVENTION

The present invention provides a method for continuously burning foamed liquid fuel in a combustion chamber which enables free control of the amount of combustion from immediately after ignition, prevention of odor generation at ignition and extinguishment, and reduction in nonuniformity of the flame when atomized fuel is burned. The method is particularly effective when applied to oil stoves.

"Foam" is used in this specification to mean aggregated bubbles constituted of a film of liquid fuel surrounding a gas such as air or oxygen.

The characteristic of foam combustion deserving special attention is that it enables an increase in the contact area between the fuel and air in a state different from than that heretofore, so that the vaporization and combustion of the fuel can be promoted.

A description will subsequently be given of the present invention with reference to the accompanying drawings.

Figure 1:
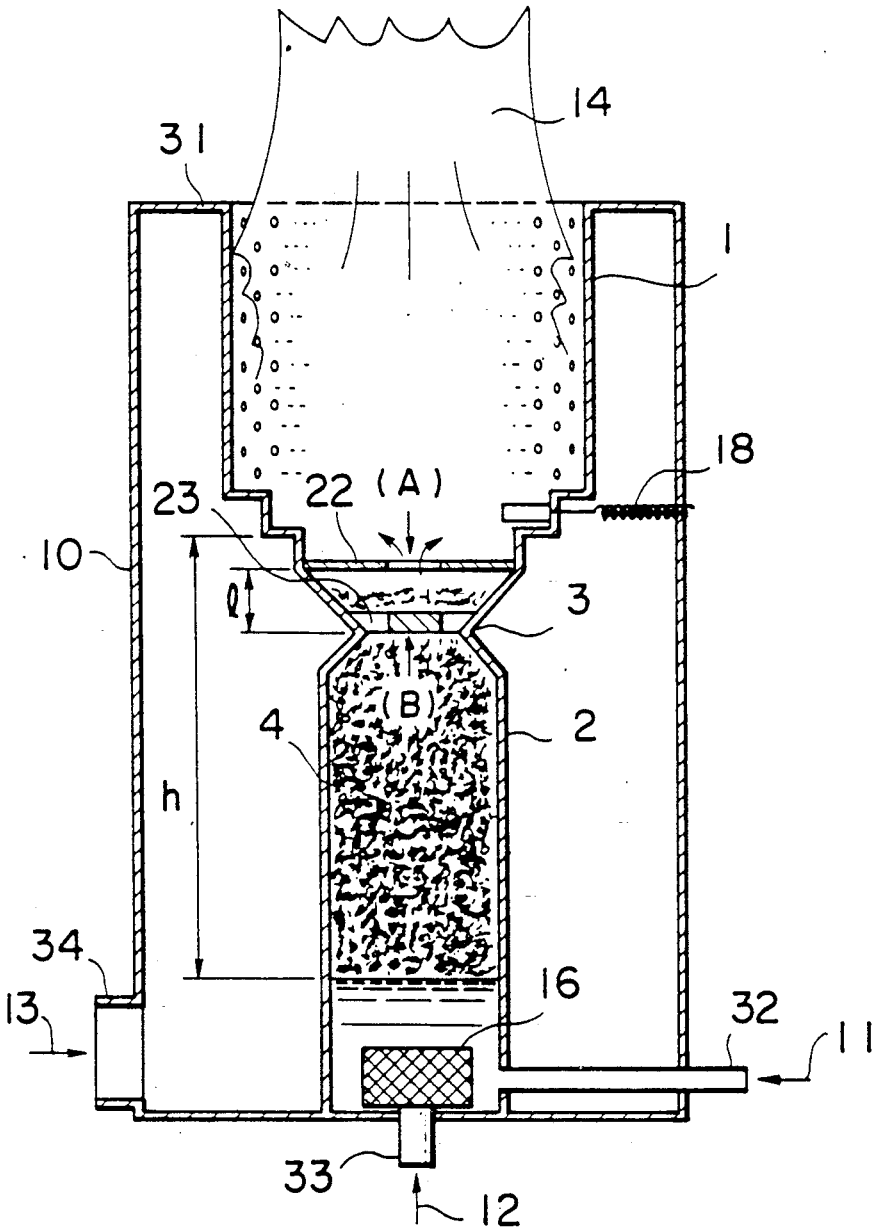
FIG. 1 is a sectional elevation view of a first embodiment of an apparatus for burning liquid fuel according to the invention.

As shown in FIG. 1, the apparatus for burning liquid fuel according to the present invention has a foam collection cylinder 2, a combustion chamber 1 and a fuel foamer 16 constituted by a porous filter accommodated within the foam collection cylinder 2. The foam collection cylinder 2 and the combustion chamber 1 are formed integrally with an outer cylinder 10 having a secondary air inlet 13. Reference numeral 11 designates fuel and 12 designates air.

An orifice 3 is formed at the boundary between the foam collection cylinder 2 and the combustion chamber 1, and a baffle plate 23 is disposed therein. The baffle plate 23 has an opening of prescribed size.

Experiments conducted show that the foam 4 within the foam collection cylinder 2 connected with the combustion chamber 1 is subjected to intense foam breaking when exposed to radiant heat from the flame 14, whereby the diameter and film thickness of the foam cells become uneven and pulsating combustion tends to occur. Therefore the orifice 3 is provided between the combustion chamber 1 and the foam collection cylinder 2 as a throttle mechanism for reducing the amount of heat radiation into the foam collection cylinder 2 from the flame 14 in the combustion chamber 1 and thus suppressing foam breakage. Nonetheless, while the provision of orifice 3 does improve the combustion characteristics, the provision of a baffle plate is effective for obtaining continuous stable combustion including that immediately after ignition.

The baffle plate 23, which is smaller than the diameter of the opening at the throttle portion, is disposed at the center of the most restricted part of the orifice 3 so that the orifice 3 and the baffle plate 23 together define an annular slit opening B through which foam is supplied into the combustion chamber 1.

Figure 4A:
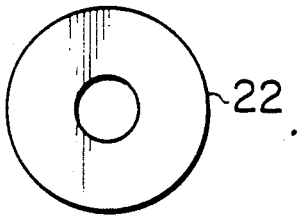
FIG. 4*a* is a plan view of a washer used in the apparatus of the embodiments of FIGS. 1 and 2.
Figure 4B:
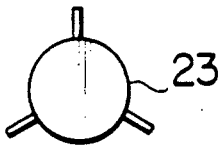
FIG. 4*b* is a plan view of a baffle plate used in the apparatus of FIGS. 1 and 2.

FIG. 4(A) is a plan view of a washer used in this invention while FIG. 4(B) is a plan view of the baffle plate 23.

The bottom surface of the combustion chamber 1 which forms the orifice 3 is conically or stepwise flared in the upward direction and a washer 22 is disposed therein at a prescribed distance above its most restricted portion. By "washer" is meant a plate with a portion at the center removed.

So as to completely prevent heat from radiating directly into the foam collection cylinder 2, the center portion of the washer 22 should be removed in such manner that there will be no open region directly above the slit opening B.

The washer 22 and the baffle plate 23 are of course appropriately spaced from each other so as to permit the passage of fuel.

The vertical positioning of the baffle plate 23 and the washer 22 can be reversed with little or no change in their effect.

While the number of baffle plates 23 and washers 22 is not limited to one each, stable continuous combustion can be obtained with only one of each.

Further, the baffle plate 23 provides the same effect even when positioned slightly below the orifice.

While the mechanism for preventing transfer of radiant heat described in the foregoing uses a combination of an orifice together with one or more baffle plates and/or washers, the invention is not limited to this arrangement, and various modifications can be made in accordance with the purpose of preventing heat transfer, without departing from the scope of the invention.

The apparatus according to this invention has an ignition mechanism disposed in the lower part of the combustion chamber.

The positioning of the ignition mechanism within the combustion chamber and at a lower part thereof in accordance with this invention ensures that adequate air for complete combustion can be supplied through the secondary air inlet and thus helps to suppress soot generation at the time of ignition.

As one example of an ignition mechanism, an electric heater 18 is provided at the lower part of the combustion chamber 1.

In the present invention, the foamer and the combustion chamber are connected by the foam collection cylinder so that the walls of the foam cells (liquid fuel) supplied to the combustion chamber can be made thin and easily vaporizable. As a result, the residence time of the foam within the collection cylinder, namely the period between foam generation and its supply to the combustion chamber, is substantially constant. The preferable residence time is 2–10 seconds. A residence period of this length promotes drainage of liquid fuel from the foamed fuel, ensures thinness of the fuel film constituted as a continuous phase, and enhances fuel burning. If the residence time is too short the foam cell walls become think and the fuel is hard to vaporize. On the other hand, if it is more than 10 seconds, marked foam breakage occurs and it becomes impossible to supply the liquid fuel stably.

In the present invention, an ignition mechanism, for example an electric heater, is provided at the lower part of the combustion chamber. As this arrangement makes it possible to supply air as required for complete combustion to the combustion chamber from the time of ignition, generation of soot and the like at the time of ignition can be suppressed.

Positioning of the electric heater at an upper part of the combustion chamber is avoided because fuel would be likely to run into the secondary air inlet and the foam would be broken by the secondary air. Positioning it too close to the orifice is also not advisable because of the higher risk of the flame flashing back into the foam collection chamber.

Experimental results show that the ignition mechanism should be capable of reliable ignition and of supporting continuous combustion at the location thereof. Thus reliable ignition cannot be obtained by spark discharge.

The foam can be easily vaporized and ignited by using a Nichrome wire type electric heater or the like as the ignition source. Especially good combustion stabilization can be realized if the heater is left on for several seconds following ignition until the combustion stabilizes.

At the time of ignition, first a damper in a secondary air duct 34 is adjusted so as to send the amount of air (about 5 $m^3N/hr$) required for preventing generation of soot and the like upon ignition. Power is then supplied to the electric heater in the combustion chamber to make it become red hot.

Foaming air is supplied to the foamer at about 2.0 l/min. Kerosine is then supplied from the upper surface of a porous filter within the foamer until it reaches a depth of about 30 mm. The resulting foamed kerosine rises through the foam collection chamber and is supplied to the combustion chamber where it is ignited.

A more advantageous structure of the foamer according to this invention will now be explained.

The main element of the ordinarily used foamer 16 is a porous filter formed of a porous sintered metallic or ceramic material.

The foamer made of this type of material is formed in the shape of a cylinder closed at one end and foaming air is supplied to it from the bottom. When foaming is conducted by immersing the foamer in liquid fuel and supplying air pressure to the bottom thereof, the air pressure inside the foamer prevents the fuel from invading the interior of the porous filter.

However, if at the time of extinguishing the flame, the supply of fuel is stopped and the supply of foaming air is discontinued at the same time, the pressure of the foaming air will drop sharply while fuel is still present in the foamer. This is not desirable because it will lead to reverse flow of the fuel and hinder foaming and ignition the next time the apparatus is operated.

This problem can be overcome by forming the porous filter of a material having a low critical surface tension, a typical example being polytetrafluoroethylene (Teflon). Alternatively, a porous filter made of a sintered metal or a porous ceramic having a high critical surface tension and coated with a substance having a low critical surface tension can be used.

The critical surface tension of the porous filter according to the present invention is lower than the surface tension of liquid fuels such as kerosine. It thus passes air but does not pass liquid fuel, whereby permeation of kerosine is prevented. Another material with a low critical surface tension that can be used is fluorocarbon resin.

Figure 11:
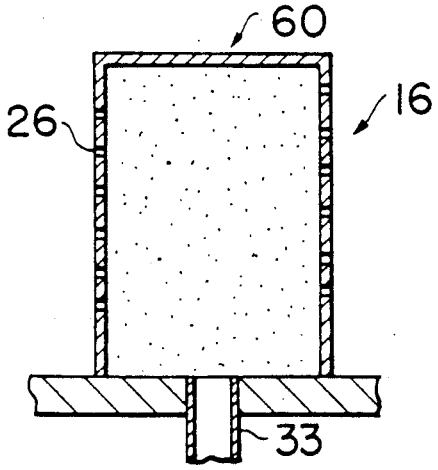
FIG. 11 is a sectional elevation view of a porous filter used in the apparatus of FIG. 1.

FIG. 11 is a vertical section of the main part of an example of such a porous filter.

The porous filter 60 according to this invention is formed as a cylinder closed at one end. It is disposed in the foamer 16 and has a foaming air inlet 33 at its bottom.

The porous filter 60 either is formed on its exterior with a coating 26 of Teflon or other substance exhibiting a low critical surface tension or is formed as a cylinder from Teflon or other such porous substance. The filter can be formed of sintered metal or porous ceramic and be coated with Teflon or the like.

Since the critical surface tension of Teflon is 22 dyn/cm in contrast to the 25 dyn/cm surface tension of kerosine, permeation of kerosine is prevented.

Foam is generated by immersing the porous filter for foam generation in kerosine and supplying it with foaming air. Tests show, however, that if the supply of foaming air to the filter is discontinued in the course of such foaming, the liquid fuel may flow back through the filter and flow into the pipe for supplying foaming air.

Therefore, for preventing flowback of the liquid fuel into the piping, it is thus necessary to employ a method of flame extinguishment wherein, when the flame is to be extinguished, the liquid fuel is instantaneously drawn off at the same time as the supply of foaming air is discontinued.

In the present invention, since a radiant heat transfer prevention mechanism is provided between the combustion chamber and the foam collection chamber which feeds fuel thereto, the foam within the foam collection chamber is not broken down by radiant heat from the flame but is maintained uniform in cell size and film thickness, whereby pulsating combustion can be prevented.

Figure 2:
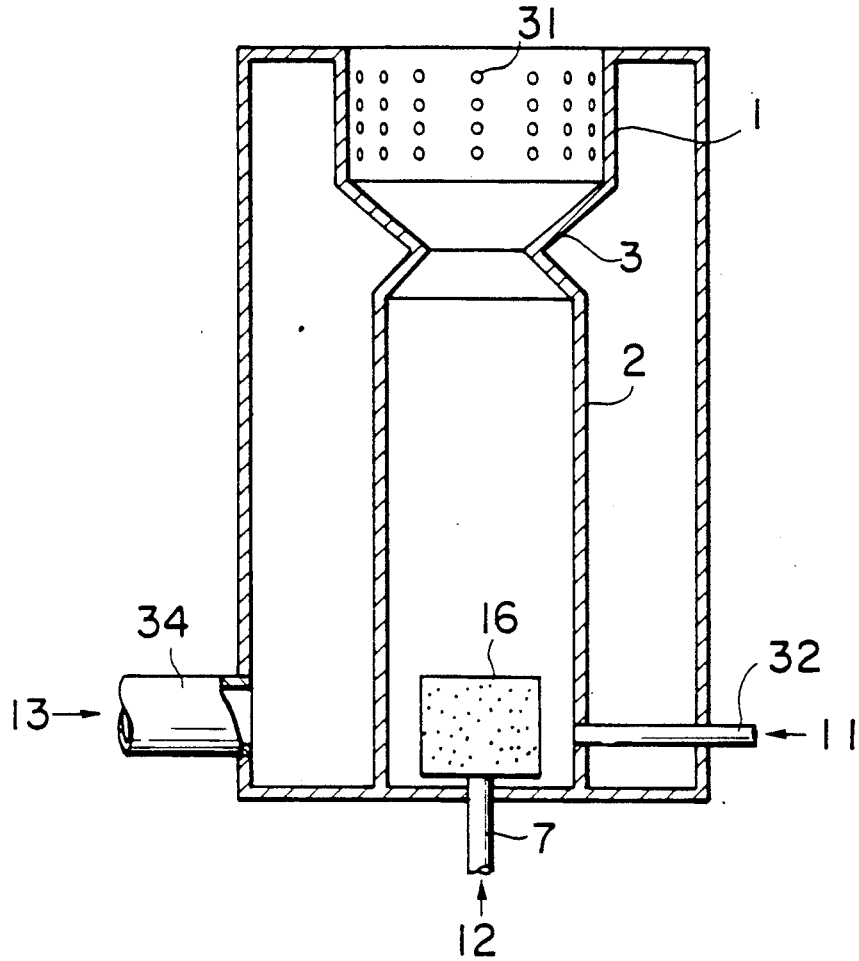
FIG. 2 is a sectional elevation view of a further embodiment of the apparatus according to the invention.
Figure 3:
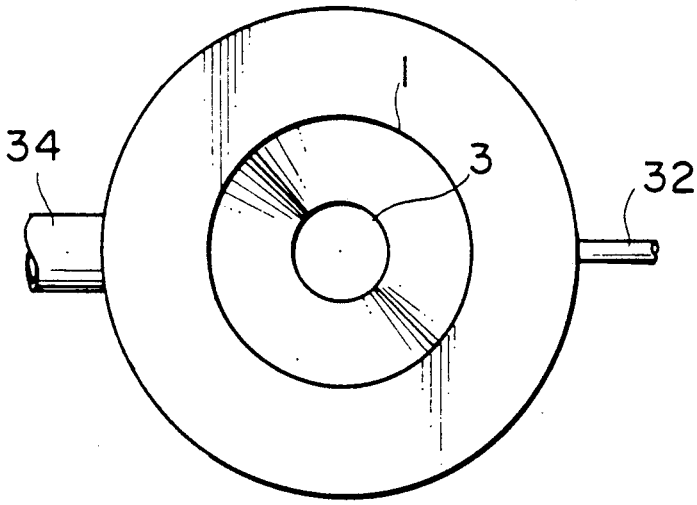
FIG. 3 is a plan view of the apparatus of FIG. 2.

FIG. 2 is a sectional view of another embodiment of the invention and FIG. 3 is a plan view of the same.

In the figures, reference numeral 1 designates a combustion chamber, 2 a foam collection cylinder, 3 an orifice, and 16 a foamer. The foamer 16 has a fuel supply pipe 32 connected to it for supply of liquid fuel from the outside.

A porous element is disposed within the foamer 16 and connected with a foaming air supply pipe 7 for supplying air or other gas thereto from the outside. Reference numeral 34 denotes a secondary combustion air supply pipe and 31 denotes secondary combustion air supply holes.

The combustion chamber 1 has the orifice 3 at its lower portion and its side wall is formed as a cylindrical or rectangular vessel. It has a large number of the secondary combustion air supply holes 31.

Preferably, the orifice 3 should flare conically upward toward the combustion chamber 1. The exterior of the region of maximum restriction is cooled by the secondary air. Since this enables variation of the area involved in vaporization of the foam, the arrangement functions as an apparatus for varying the amount of vaporization.

Thus the foamed fuel arrives at the orifice 3 from the foam collection cylinder 2 and is supplied to the combustion chamber 1 through the opening thereof, and can be easily burned in the combustion chamber 1 using the air within the foam and the air supplied from the secondary combustion air supply holes 31, whereby a flame is formed in the upper part of the combustion chamber 1.

Figure 5:
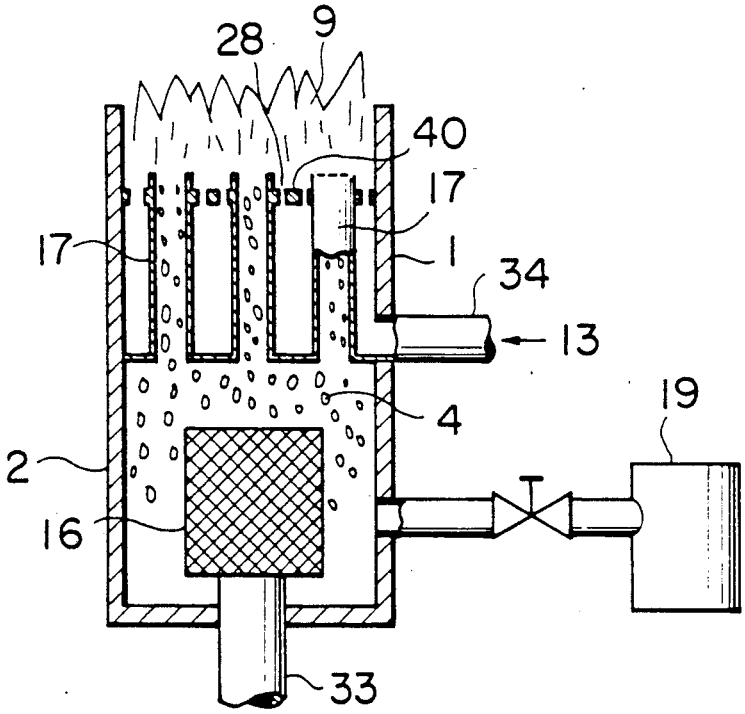
FIG. 5 is a sectional elevation view of a still further embodiment of the apparatus according to the invention.
Figure 6:
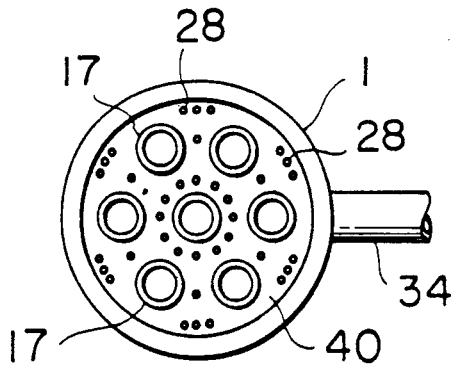
FIG. 6 is a plan view of the apparatus of FIG. 5.
Figure 7:
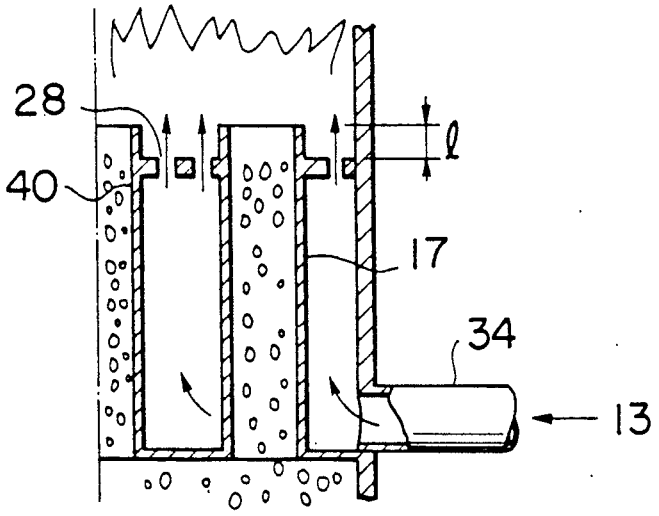
FIG. 7 is an enlarged sectional view of a part of the apparatus of FIGS. 5 and 6.

FIG. 5 is a sectional view of another embodiment of the apparatus according to the invention. FIG. 6 is a plan view of the same and FIG. 7 is an enlarged view of one part thereof.

In this embodiment, the combustion chamber 1 and the foam collection cylinder 2 are integrated into a single body having an opening in which a plurality of open-ended foam riser tubes 17 stand upright. As shown in FIG. 6, the foam riser tubes 17 are circular in cross section and are disposed in an annular pattern within the combustion chamber 1.

It should be noted that these structures are not limited to those described above and, for example, the combustion chamber 1 and the foam collection cylinder 2 can be formed separately and connected by a pipe. Moreover, the cross-sectional configuration of the foam riser tubes 17 need not necessarily be circular but may instead be rectangular or slit-like. Regardless of which of these arrangements is used, the combustion chamber 1 is provided on its side wall with a secondary combustion air supply pipe 34 through which air or other source of the oxygen required for combustion is supplied. This arrangement provides a function equivalent to that provided by the orifice shown in FIGS. 1 and 2.

The combustion chamber is closed by a face plate 40 having a number of air nozzles 28 formed therein.

By experiment it was found that uniform combustion could be obtained when the foam riser tubes 17 were formed to project to a height l above the surface of the face plate 40, as shown in FIG. 7.

The bubbling expansion ratio (foam volume/liquid fuel volume) obtainable with only a liquid fuel such as kerosine ranges from approximately 5 to 50 times. In contrast, the air expansion ratio required for complete combustion using only the air (oxygen) contained in the foam is approximately 9,000 times (approximately 1,900 times in the case of oxygen).

In foam combustion, therefore, it is necessary to supply additional combustion air separately from the foaming air (the air contained in the foam cells). If an attempt should be made to introduce this separately supplied additional combustion air directly into the foam cells, the boundary surfaces among the bubbles constituting the foam, in other words the plateau boundary of the foam, would become unstable and foam breakdown would be promoted.

This in turn would lead to nonuniformity in the diameter and wall thickness of the foam cells to be burned and hinder stable combustion by triggering pulsating combustion or the like.

Thus for obtaining stable combustion by supplying combustion air directly to the foam it suffices to avoid the need for supplying the combustion air into the foam cells by instead forming the foam as small aggregates of bubbles and then to carry out combustion with these aggregates enveloped by combustion air.

In the present embodiment of the invention, since the foam is introduced into the combustion chamber via a plurality of upright foam riser tubes and secondary air is supplied around these tubes from the air nozzles, complete combustion of the fuel is possible.

Figure 8:
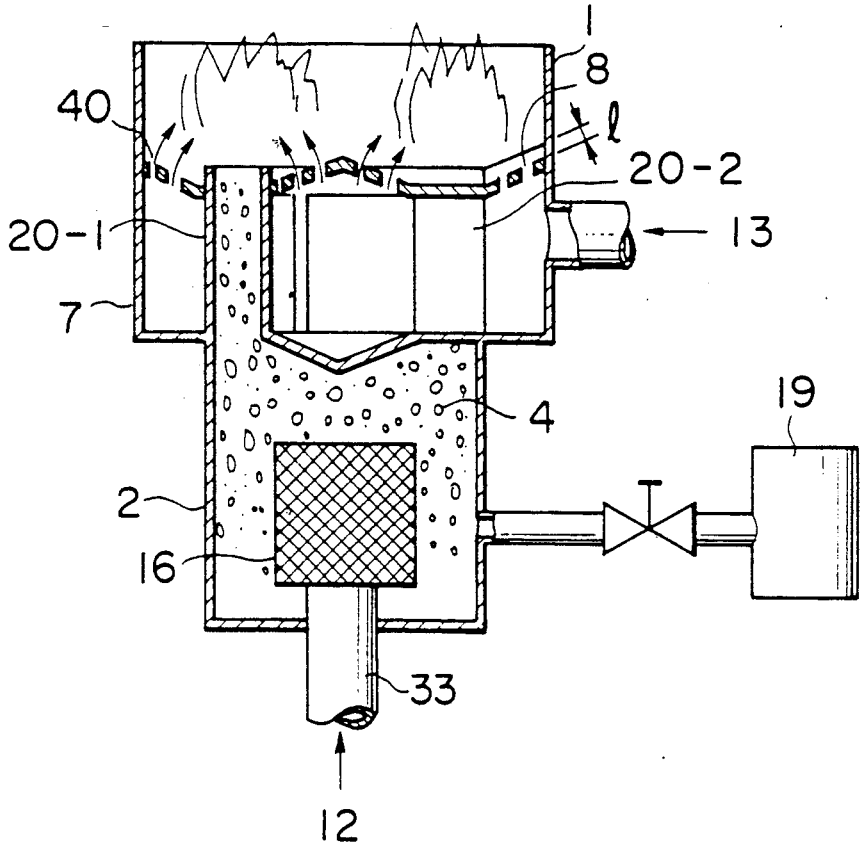
FIG. 8 is a sectional elevation view of a further embodiment of the apparatus according to the invention.
Figure 9:
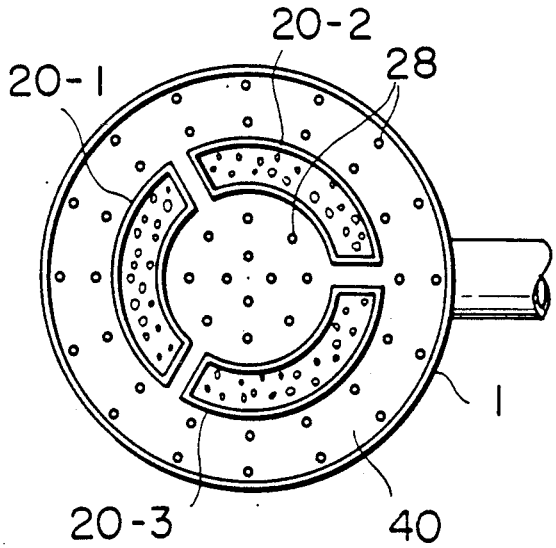
FIG. 9 is a plan view of the apparatus of FIG. 8.

FIGS. 8 and 9 show another embodiment of the apparatus according to this invention. In this arrangement, upright slit-shaped riser tubes 20-1, 20-2, 20-3 are disposed within and concentrically with the combustion chamber 1. The combustion chamber 1 is provided with an air box 7 closed at the top by a face plate 40 having air nozzles 28 formed therein. The slit-shaped riser tubes 20-1, 20-2, 20-3 project above the face plate by a height l so as to form a combustion zone.

In this embodiment of the invention, foam is formed by supplying foaming air 12 through pipe 33 to the liquid fuel supplied from tank 19 through a porous element 16. The so-formed foam passes from foam collection chamber 2 up through the slit-shaped riser tubes and is subjected to complete combustion in the upper region by air 13 supplied so as to envelop the foam.

If the width of the slits is made 30 mm or less, complete combustion can be attained solely by drawing in ambient air 13, without need for the forced supply of air 13 for combustion. In this case, however, the rate of combustion is slow so that the flame may grow long and produce soot. Whether or not forced air supply is necessary therefore depends on the size of the combustion chamber and the purpose to which the apparatus is put. This embodiment enables easy ignition without need for a wick and makes it possible to readily control the amount of combustion from immediately after ignition. A stove employing the apparatus is therefore able to supply heat from a time immediately after turn-on.

Moreover, the production of an unpleasant odor at the time of ignition and extinguishment, which is unavoidable with conventional direct vaporization combustion, is completely prevented.

Figure 10:
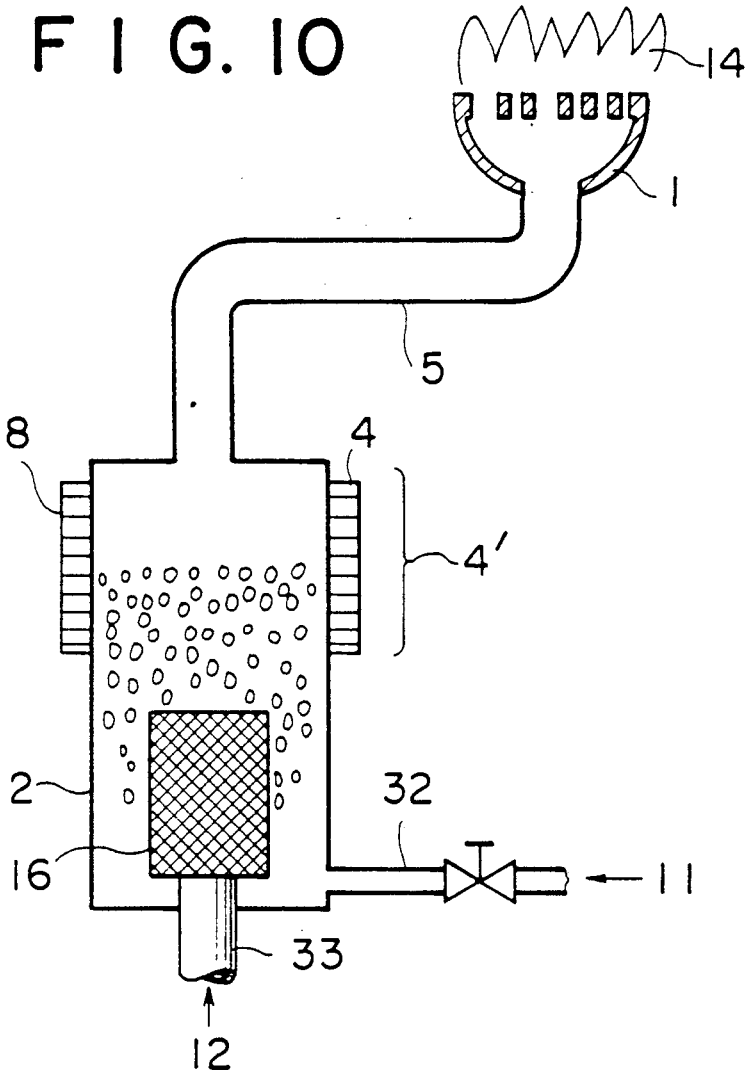
FIG. 10 is a schematic sectional elevation of a further embodiment of the apparatus according to the invention.

Another embodiment of the invention will now be explained with reference to FIG. 10.

In this embodiment, a vaporization chamber 4 is provided to extend upward from the foam collection cylinder 2. The vaporization chamber 44 is provided with a heating zone 4' employing, for example, a heater 8. The heating zone supplies the heat needed for vaporization of the foam.

The vaporization chamber 44' is communicated with a combustion chamber (burner) 1 by a vapor duct 5. The vapor duct 5 has a smaller cross-sectional opening area than the cross-sectional opening areas of the foam collection cylinder and the combustion chamber. It provides substantially the same function as the orifice shown in FIGS. 1 and 2. In this embodiment, since the foamed fuel is burned after being forcibly vaporized, the combustion chamber or burner can be located at a distance from the foam-forming zone. Moreover, since the vapor duct can be bent for avoiding exposure of the foam-forming zone to radiant heat from the flame (which would lead to increased foam breaking in the case of foam conveyance), the temperature of the foam-forming zone 4 (where the liquid fuel is retained) can be kept from rising.

This means that there is no particular limitation on the material of the vapor duct used to connect the burner with the foam-forming zone. The vapor duct can thus be made of even a metal material such as steel or copper.

Further, since the amount of foam supplied to the vaporization chamber 44 can be varied by varying the amount of foaming air 12 supplied through pipe 33 to foamer 16 the amount of vaporization can be easily controlled.

More specifically, since the amount of foam formed can be easily varied such as by varying the supplied amount of foaming air, the amount of vaporization can thus also be simply controlled. Moreover, vaporization can be quickly stopped by stopping the supply of the foaming air.

Thus where the liquid is a fuel such as kerosine, it is burned only after first being foamed and then vaporized so that the combustion can be treated as that of a gas.

While the foregoing explanation was made mainly with respect to the simple vaporization chamber illustrated in the drawing, a further improvement in heat transfer efficiency and vaporization stability can be realized by providing vaporization chambers on a plurality of foam riser tubes or slit-shaped riser tubes arranged annularly.

As in this embodiment a liquid fuel is burned after first being foamed and then being forcibly vaporized by heating, the apparatus has the effect of enabling easy control of the amount of vaporization. Furthermore, it is possible to increase the distance between the foam collection cylinder and the combustion chamber or burner, whereby radiant heat from the flame can be prevented from reaching the foam collection chamber.

The method of flame extinguishment in accordance with this invention will now be explained.

Figure 12:
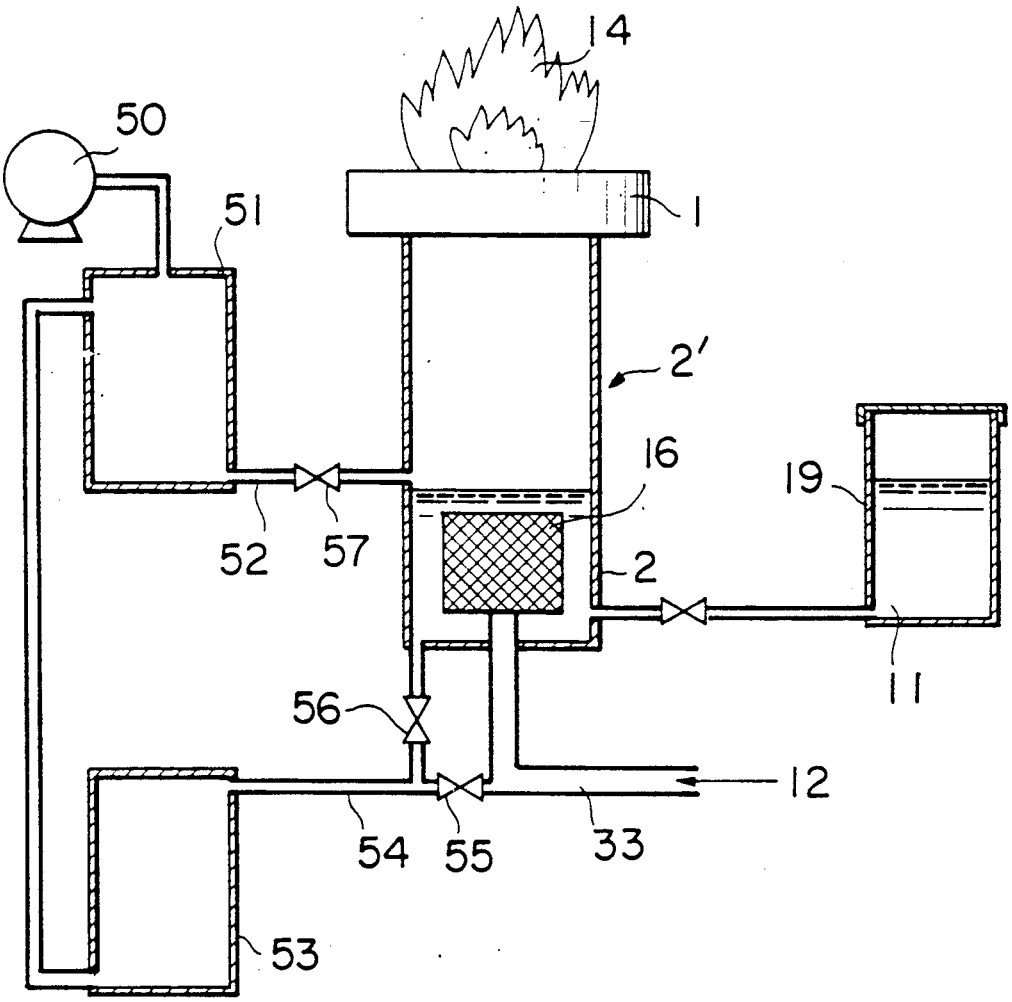
FIG. 12 is a diagrammatic view for illustrating the method of extinguishing the flame in an apparatus according to the invention.

Referring to FIG. 12, the porous element 16 provided in the foam collection cylinder 2 is connected with a foaming air pipe 33 for supplying foaming air 12 thereto. Reference numeral 19 designates a fuel supply tank and 1 the combustion chamber. Liquid fuel is foamed in the foam collection cylinder 2 and the ascending foam is supplied with combustion air (not shown) to be completely burned.

For maintaining combustion in this foam burning apparatus it is necessary to continuously supply liquid fuel into the foam collection cylinder 2 for maintaining the liquid fuel level therein.

The ordinary way of carrying out extinguishment when combustion of fuel is in progress in this state is to first discontinue the supply of fuel.

In the foaming burning system according to the present invention, not only is the supply of fuel stopped but the supply of foaming air 12 is also discontinued. When this is done, the level of the foamed fuel being supplied to the combustion chamber 1 falls rapidly, causing the flame to go out.

However, a small amount of fuel remains in the foam collection cylinder 2. In the present invention, this fuel is drawn off rapidly, simultaneously with extinguishment of the flame, so that no fuel remains in the foam collection cylinder 2.

In the figure, reference numeral, 56 designates a solenoid valve for controlling withdrawal of fuel form the foam collection cylinder 2. It is connected with an auxiliary tank 53 via a fuel withdrawal pipe 54. Reference numeral 55 denotes a solenoid valve provided in a line connecting the foaming air pipe 33 with the fuel withdrawal pipe 54. Reference numeral 51 denotes a temporary storage tank for the withdrawn fuel, 50 a suction pump, 52 a fuel return pipe and 57 a solenoid valve disposed in the fuel return pipe 52.

Specifically, the supply of foaming air 12 is discontinued so as to stop the combustion (extinguishment). At the same time, the fuel supply line valve is closed, solenoid valve 56 is opened and the suction pump 50 is actuated to draw any remaining fuel out of the foam collection cylinder 2 and into the tank 51 via the fuel withdrawal pipe 54 and auxiliary tank 53.

Later, when the apparatus is to be operated again, foaming air 12 is supplied to an extent sufficient to prevent the fuel from flowing into the foaming air pipe 33 and the fuel in the tank 51 is simultaneously returned to the foam collection chamber via the return pipe 52 by opening valve 57 whereafter the fuel is ignited.

When extinguishment is conducted in this manner, no odor is produced whatsoever since the combustion chamber contains no fuel which can evaporate.

Since the fuel is drawn out of the foam collection cylinder 2 simultaneously with extinguishment, it also possible to prevent fuel from flowing through the porous element 16 into the foaming air pipe 33.

Further, by the provision of the solenoid valve 55 between the foaming air pipe 33 and the fuel withdrawal pipe 54, it becomes possible by opening the valve 55 and actuating the suction pump 50 to draw out any fuel that might for some unpredictable reason find its way into the foaming air pipe 33 and thus to prevent pressure loss or fluctuation when the apparatus is next operated.

If desired, the operations of first opening the solenoid valve 56 and withdrawing fuel from the foam collection cylinder 2 and thereafter opening the solenoid valve 55 and using the suction pump 50 to withdraw any fuel that may have entered the foaming air pipe 33 can be conducted automatically at the time of each extinguishment.

What is claimed:

1. A method for burning liquid fuel comprising the steps of:

foaming liquid fuel with a primary combustion supporting gas;

retaining the foamed fuel for a residence time of 2-10 seconds during which any liquid fuel in the thus foamed fuel is drained therefrom;

supplying secondary combustion supporting gas sufficient for continuous stable combustion of the foamed fuel to the thus retained foamed fuel; and burning the foamed fuel in a combustion chamber.

2. A method as claimed in claim 1 in which the step of foaming comprises providing the liquid fuel and the primary combustion supporting gas to a foamer, and said method further comprises extinguishing the burning fuel by stopping the supply of primary combustion gas which is used for the foaming of the fuel to the foamer and stopping the supply of fuel to the foamer, and simultaneously withdrawing from the foamer any fuel remaining therein.

3. An apparatus for burning liquid fuel, comprising:

a vertically oriented foam collection cylinder;

means for feeding a liquid fuel into the lower part of said foam collection cylinder for forming a body of liquid fuel in the lower part of said foam collection cylinder; a liquid fuel foamer disposed in a lower part of said foam collection cylinder for feeding a primary combustion supporting gas into a body of fuel in the lower part of said foam collection cylinder;

a combustion chamber; and an orifice defining means connected between the upper part of said foam collection cylinder and said combustion chamber and defining an orifice between said foam collection cylinder and said combustion chamber, said orifice having a smaller cross-sectional area than the cross-sectional areas of said foam collection cylinder and said combustion chamber.

4. An apparatus as claimed in claim 3 in which said orifice is conically flared upwardly, and said apparatus further comprising means for flowing a cooling medium over the exterior surface of said orifice defining means.

5. An apparatus as claimed in claim 4 in which said means for flowing a cooling medium comprises means for flowing a secondary combustion supporting gas.

6. An apparatus as claimed in claim 3 in which said orifice is stepwise flared upwardly, and said apparatus further comprising means for flowing a cooling medium over the portion of said orifice defining means defining the smallest diameter stepped portion of said orifice.

7. An apparatus as claimed in claim 6 in which said means for flowing a cooling medium comprises means for flowing a secondary combustion supporting gas.

8. An apparatus as claimed in claim 3 in which said orifice defining means further comprises means for blocking heat radiating from said combustion chamber from reaching said foam collection cylinder.

9. An apparatus as claimed in claim 8 in which said means for blocking comprises a baffle plate having a diameter smaller than the diameter of the orifice and disposed at the most restricted portion of the orifice and having an outer peripheral edge spaced from the inner wall of said orifice for defining an annular slit therearound, and a washer having an open center and disposed above said baffle plate with said opening over said baffle plate.

10. An apparatus as claimed in claim 3 further comprising an ignition mechanism provided at a lower part of said combustion chamber.

11. An apparatus as claimed in claim 3 wherein said foamer comprises a porous filter of a material having a surface with a lower critical surface tension than the surface tension of the liquid fuel, an said means for feeding the primary combustion supporting as comprises an air supply line connected to the bottom of said porous filter for supplying air to the bottom of said filter.

12. An apparatus for burning liquid fuel, comprising:
a vertically oriented foam collection cylinder;
means for feeding a liquid fuel into the lower part of said foam collection cylinder for forming a body of liquid fuel in the lower part of said foam collection cylinder;
a liquid fuel foamer disposed in a lower part of said foam collection cylinder for feeding a primary combustion supporting gas into a body of fuel in the lower part of said foam collection cylinder;
a combustion chamber; and
a plurality of foam riser tubes connected between said foam collection cylinder and said combustion chamber, each having a cross-sectional area smaller than the cross-sectional area of said foam collection cylinder and said combustion chamber.

13. An apparatus as claimed in claim 12 in which said foam riser tubes are tubular bodies having a circular cross-section.

14. An apparatus as claimed in claim 12 in which said foam riser tubes are tubular bodies having a slit-like cross-section.

15. An apparatus for burning liquid fuel, comprising:
a vertically oriented foam collection cylinder;
means for feeding a liquid fuel into the lower part of said foam collection cylinder for forming a body of liquid fuel in the lower part of said foam collection cylinder;
a liquid fuel foamer disposed in a lower part of said foam collection cylinder for feeding a primary combustion supporting gas into a body of fuel in the lower part of said foam collection cylinder, said foam collection cylinder having a vaporization chamber in the upper part thereof and a heat source in said vaporization chamber for vaporizing the foamed fuel;
a combustion chamber; and
a vapor duct extending from said vapor chamber to said combustion chamber and having a smaller cross-sectional area than the cross-sectional area of said foam collection cylinder and said combustion chamber.

16. An apparatus as claimed in claim 15 in which said heat source is an electric heater.

17. An apparatus as claimed in claim 15 in which said vapor duct is curved for blocking heat radiated from said combustion chamber from reaching said vaporization chamber along said vapor duct.

* * * * *